US012116739B2

(12) United States Patent
Henning et al.

(10) Patent No.: US 12,116,739 B2
(45) Date of Patent: Oct. 15, 2024

(54) SKID DEVICE ATTACHABLE TO LOADER BUCKET, LOADER BUCKET ASSEMBLY FOR MOVING MATERIAL, AND METHOD THEREOF

(71) Applicant: R2 Manufacturing LLC, Alden, NY (US)

(72) Inventors: Ryan G. Henning, Leesburg, VA (US); Robert K. Henning, Alden, NY (US)

(73) Assignee: R2 MANUFACTURING LLC, Alden, NY (US)

( * ) Notice: Subject to any disclaimer, the term of this patent is extended or adjusted under 35 U.S.C. 154(b) by 885 days.

(21) Appl. No.: 17/201,603

(22) Filed: Mar. 15, 2021

(65) Prior Publication Data

US 2021/0198858 A1 Jul. 1, 2021

Related U.S. Application Data

(63) Continuation-in-part of application No. 16/653,368, filed on Oct. 15, 2019, now abandoned.

(51) Int. Cl.
*E01H 5/06* (2006.01)
*E02F 3/40* (2006.01)

(52) U.S. Cl.
CPC ..... *E01H 5/066* (2013.01); *E02F 3/401* (2013.01)

(58) Field of Classification Search
CPC ..... E02F 3/401; E01H 5/066
See application file for complete search history.

(56) References Cited

U.S. PATENT DOCUMENTS

| | | | |
|---|---|---|---|
| 1,395,048 | A | 10/1921 | McKee |
| 2,333,361 | A | 11/1943 | Churchill |
| 2,593,025 | A | 4/1952 | Hanson |
| 2,840,936 | A | 7/1958 | Rand |
| 2,884,720 | A | 5/1959 | Meyer |
| 3,281,972 | A | 11/1966 | Kerestes |
| 4,043,061 | A | 8/1977 | Heitman |
| 4,125,952 | A | 11/1978 | Jennings |
| 4,182,057 | A | 1/1980 | Klett |
| 4,597,205 | A | 7/1986 | Guest |
| 4,671,000 | A | 6/1987 | Kim |
| 4,899,472 | A | 2/1990 | Winter |
| 4,944,104 | A | 7/1990 | Kowalczyk |
| 5,142,801 | A | 9/1992 | Feller |

(Continued)

OTHER PUBLICATIONS

Office Action issued in U.S. Appl. No. 16/653,368 on Nov. 23, 2021.

(Continued)

*Primary Examiner* — Jamie L McGowan
(74) *Attorney, Agent, or Firm* — ROSSI, KIMMS & McDOWELL LLP

(57) ABSTRACT

A skid device and a loader bucket assembly includes the skid device, which include a ski-shaped base plate. The skid device is attachable to a front end of a loader bucket including a plurality of mounting holes for securing an accessory, such as an edge plate and a toothbar, to a bottom side of the loader bucket at a front side thereof, with a portion of the accessory extending forwardly of a front edge of the loader bucket when the accessory is mounted to the loader bucket. The skid device is also attachable to the loader bucket without the accessory mounted thereto. Two or more skid devices can be attached to the front end of the loader bucket to enable it to move materials on the ground.

21 Claims, 11 Drawing Sheets

(56) References Cited

U.S. PATENT DOCUMENTS

| | | | |
|---|---|---|---|
| 5,564,885 | A | 10/1996 | Staben, Jr. |
| 5,638,617 | A | 6/1997 | Belanger |
| 6,240,662 | B1 | 6/2001 | Borowiak |
| 6,718,662 | B1 | 4/2004 | Schaff |
| 7,658,024 | B2 | 2/2010 | Launder |
| 8,281,505 | B2 | 10/2012 | Karlsson |
| 9,133,599 | B2 | 9/2015 | Henning |
| 2006/0288617 | A1 | 12/2006 | Colclough |
| 2008/0263907 | A1 | 10/2008 | Winter |
| 2011/0315465 | A1 | 12/2011 | Henry |
| 2012/0074662 | A1 | 3/2012 | Sayre |
| 2014/0366406 | A1 | 12/2014 | Guggino |
| 2016/0069032 | A1 | 3/2016 | Winter |
| 2017/0247847 | A1 | 8/2017 | Maile |
| 2019/0177939 | A1 | 6/2019 | Guggino |

OTHER PUBLICATIONS

Notice of Allowance issued in U.S. Appl. No. 16/653,368 mailed Apr. 27, 2022.

SKID DEVICE ATTACHABLE TO LOADER BUCKET, LOADER BUCKET ASSEMBLY FOR MOVING MATERIAL, AND METHOD THEREOF

BACKGROUND

Displacing materials, such as snow on a gravel driveway or the lifting of mulch or cut wood off a lawn using a loader bucket, which has a long, flat leading edge, can quite easily cut into the underlying ground when trying to lift or move material. This can result in a damaged lawn, or driveway stones in a pile of snow while attempting to clear them.

The present inventors have devised an EDGE TAMER, which is a unique skid device that is attachable to loader buckets. See U.S. Pat. No. 9,133,599. This skid device, which has a ski-shaped ends, simple to attach, without needing to modify the loader bucket, with a fastener. The skid device also can include a replaceable wear member for improved gliding and longevity. The skid device disclosed in this patent is quite useful for pushing snow, moving mulch or dirt on grass, cut wood, or any similar material with a tractor, skid-loader, or other machine with a loader bucket, in situations where preserving the underlying surface is a priority. For example, it is desirable to leave the stones in a driveway when pushing snow, not damage the grass when lifting a pile or mulch or cut wood, or avoid damaging expansion joints on a concrete surface when clearing it off dirt or snow.

Although the EDGE TAMER is simple to attach to a loader bucket without needing to modify the loader bucket, and is quite useful, the EDGE TAMER uses tension to secure the skid device to a loader bucket. But tension securing is not as practical for large applications, such as wheel loaders. There still remains a need for an improved skid device that is simpler and more economical to manufacture. The present development addresses this need.

SUMMARY OF THE INVENTION

One aspect of the present development is a skid device mountable to a loader bucket including a plurality of mounting holes for securing an accessory to a bottom side of the loader bucket at a front side thereof, with a portion of the accessory extending forwardly of a front edge of the loader bucket when the accessory is mounted to the loader bucket. The accessory can be an edge plate.

The skid device includes a base plate, which includes a first section, a second section, and a third section. The first section includes a slot extending in a fore and aft direction of the base plate. The second section extends outwardly and angled upwardly from the first section. The third section extends outwardly and angled upwardly from the first section, with the second and third sections extending in opposite directions along the fore and aft direction from the first section.

The width of the slot is dimensioned to permit a threaded shaft of a fastener to pass through a mounting hole, among the plurality of mounting holes in the loader bucket, from a bottom side of the first section, while preventing a head of the fastener, which is disposed at one end of the threaded shaft and dimensioned larger than the threaded shaft, from passing completely through the slot.

The skid device further includes a stop member disposed at an upper side of the first section adjacent to one of the second or third section and configured to abut a leading end of the loader bucket. When the skid device is mounted to the loader bucket, the stop member abuts the leading end of the loader bucket with or without the accessory mounted to the loader bucket. The skid device can be mounted to the loader bucket with either the second or third section extending forwardly of the leading end of the loader bucket.

The length of the slot provides a fore and aft adjustment that allows the skid device to be mountable to the loader bucket with or without the accessory mounted, so that the stop member abuts the leading end, which is either the front edge of the loader bucket in a case where the accessory is not mounted or a front edge of the accessory extending forwardly of the front edge of the loader bucket in a case where the accessory is mounted.

The base plate can be made of monolithic aluminum or steel. The first section is thicker than each of the second and third sections. Alternatively, a reinforcing section can extend upwardly from an upper side of the first section. The reinforcing section can have a slot that is narrower than the slot in the first section and permit the threaded shaft of the fastener to extend therethrough but prevent the head of the fastener from passing through. The slot can be stepped or countersunk deeper than a thickness of the head of the fastener so that the head is at least flush with a bottom surface of the first section. The stop member can extend upwardly from an upper side of the first section or the reinforcing section.

The skid device can include a wear member removably secured to a lower side of the base plate and configured complementary to a configuration of the base plate and cover a bottom surface of the base plate.

The skid device can include an accessory mount extending from the first section and the stop member. The auxiliary member is removably attachable to the accessory mount. The accessory mount comprises a gusset plate with a notch that prevents the auxiliary member from pivoting upwardly in a state where the auxiliary member is mounted to the accessory mount.

Another aspect of the present development is a loader bucket assembly for moving material. The loader bucket assembly includes the loader bucket as described above and at least two skid devices mounted to the loader bucket. Each of the skid devices can be configured as described above.

Another aspect of the present development is a method of mounting the skid device described above to the loader bucket described above. The method includes providing the skid device as described above, disposing the skid device underneath the load bucket so that the first section is underneath the load bucket and the stop member is disposed close to or abutting the leading end of the loader bucket, aligning the slot with the mount hole, inserting the threaded shaft of the fastener through the slot and into the mount hole, and securing the skid device to the load bucket by fastening the nut on the thread shaft and tightening the nut while the stop member is abutting the leading end.

DETAILED DESCRIPTION

Generally, two types of loader buckets exist: one type with a single cutting edge and another type with double cutting edges. The single cutting edge loader bucket typically comes with a factory welded-on cutting edge that is not readily replaceable (would require welding to repair or replace the original cutting edge). The double-sided cutting edge loader bucket, which comes with a bolted-on edge plate that has double-sided edges, is attached to the loader bucket using bolts extending through holes already existing in the loader bucket. Thus, the edge plate 12 is replaceable. The edge plate is one of many accessories of the loader bucket.

Figure 1:
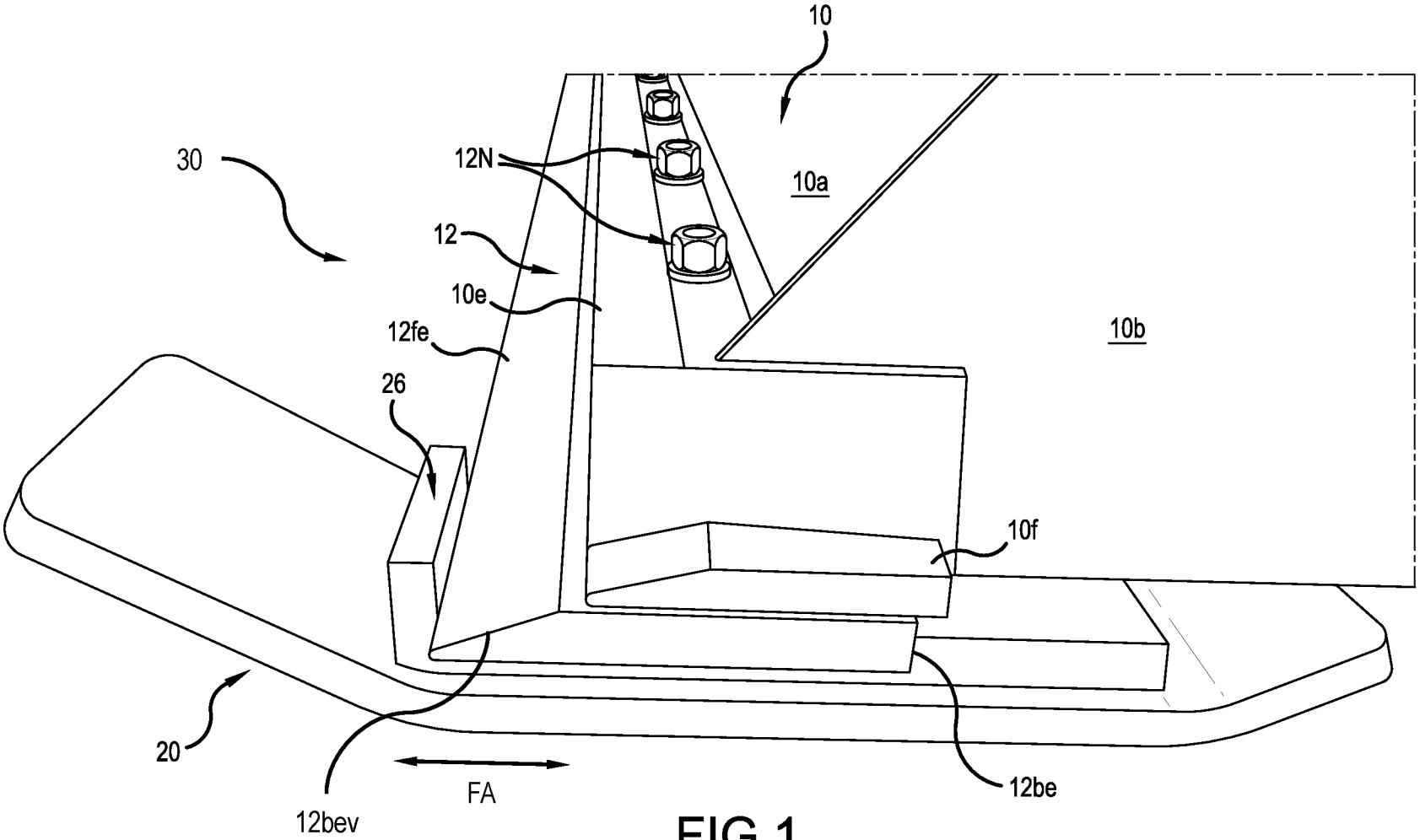
FIG. 1 illustrates a perspective view of a loader bucket assembly, including a skid device according to an embodiment of the present development attached close to a left side of a loader bucket that includes an accessory in a form of an edge plate attached to the underside thereof using bolts extending through existing mounting holes in the loader bucket.
Figure 2:
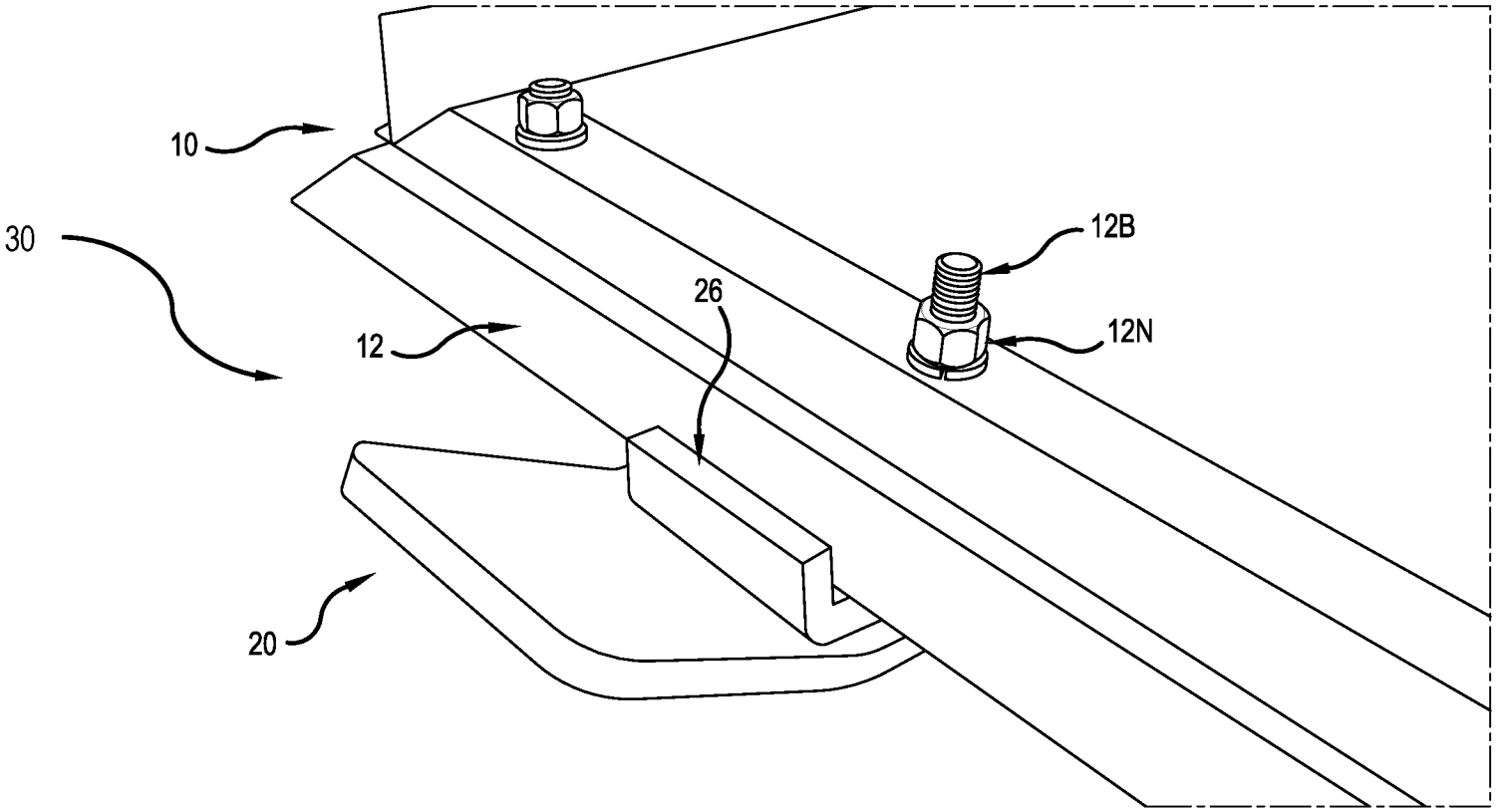
FIG. 2 illustrates another perspective view of the loader bucket assembly, but with another skid device installed at a different location (closer to the right side) of the loader bucket illustrated in FIG. 1.
Figure 3:
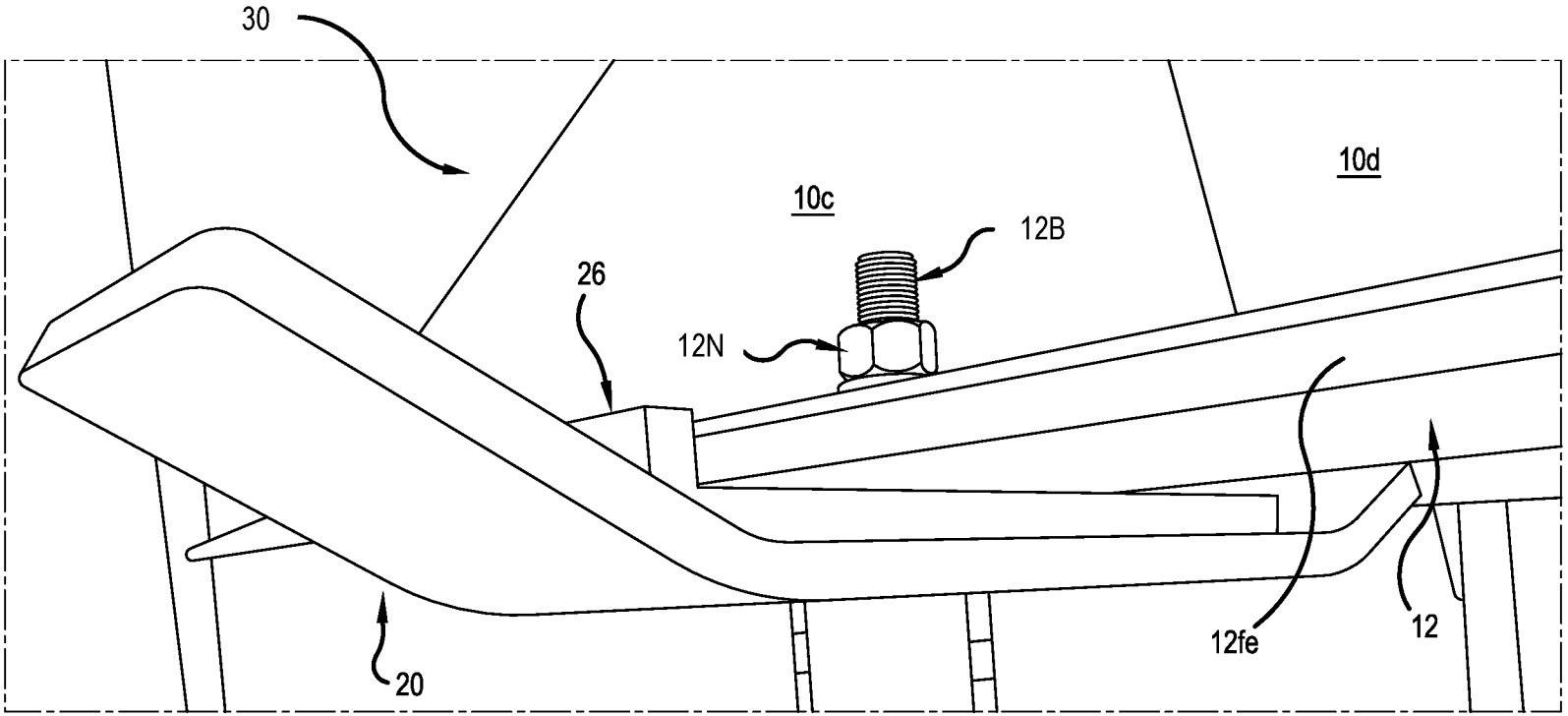
FIG. 3 illustrates yet another perspective view of the loader bucket assembly illustrated in FIG. 2.

FIGS. 1-3 illustrate a loader bucket assembly 30 including a double-sided cutting edge loader bucket 10 (hereafter simply "loader bucket") and at least two skid device 20 attached thereto (only one shown in each figure). The loader bucket 10 can be any loader bucket of the type with built in mounting holes for receiving fasteners, namely bolts 12B and nuts 12N, that secure an edge plate 12 to the underside of the loader bucket. The present development takes advantage of the existing mount holes to secure the skid device 20 without requiring any modification to the loader bucket, although the skid device 20 can be mounted to a single cutting edge loader bucket by drilling holes or to existing holes.

The loader bucket is typically configured to have an inner volume sufficient to hold loose materials, such as dirt, sand, rocks, and even snow. Specifically, referring to FIGS. 1-3, the loader bucket 10 typically can have a bottom portion 10*a*, left and right side portions 10*b*, 10*c* (from the vantage of the driver), and a back portion 10*d* (see FIG. 3) all integrally held together to form a rigid structure having the inner volume sufficient to hold materials. Excavator buckets can even have teeth protruding from the edge plate 12, and configured to disrupt material. The loader bucket 10 also has a connecting mechanism (not shown) for attaching to a tractor or the like. The connecting mechanism is also conventional.

Referring to FIG. 1, the bottom portion 10*a* of the loader bucket is typically flat. The front portion of the underside of the bottom portion 10*a* is where the upper side of the accessory (edge plate) 12 is disposed and secured using fasteners, namely the bolts 12B and nuts 12C (see FIGS. 1-3). The edge plate 12 is typically flat and includes two edges, namely a front edge 12*fe* and a back edge 12*be* (which can be symmetrical). The front edge 12*fe* of the edge plate 12 extends beyond the front edge 10*e* of the loader bucket 10. Although the illustrated embodiment shows only the front edge 12*fe* with a bevel 12*bev*, the back edge 12*be* also can include a symmetrical bevel, which allows for the edge plate 12 to be reversely mounted with the back edge 12*be* forwardly of the front edge 10*e* of the loader bucket when the front edge 12*fe* wears out.

Still referring to FIG. 1, the front side of the loader bucket is typically made thicker, namely reinforced for strength and durability. The thicker portion can end abruptly or gradually, leaving an underside wall having some thickness (height) that forms the lip portion 10*f*. In other words, the underside of the bottom portion 10*a* has a stepped configuration, with the distal side of the front end being raised from the proximal side of the lip portion 10*f*.

FIGS. 4-7 illustrate the skid device 20 itself (identified as EDGE TAMER II or BOLT-ON TAMER), which is removably attachable to the loader bucket 10, with or without the edge plate 12. The skid device 20 beneficially can be attached to the loader bucket 10 without the edge plate 12 installed, so that the front edge 10*e* of the loader bucket 10 becomes the leading edge. But if the edge plate 12 is mounted to the loader bucket 10, the edge 12*fe* or 12*be* of the edge plate 12 becomes the leading edge of the loader bucket 10.

The skid device 20 is provided with a universal fitment. Specifically, aligned slots 22*s*, 24*s* are provided to give the operator the flexibility to slide the device longitudinally in a fore and aft direction FA on the loader bucket 10 to accommodate the loader bucket 10 either with or without the edge plate 12 installed using an existing bolt hole, as well as to fit differently dimensioned loader buckets. Whereas the universal fitment arrangement disclosed in U.S. Pat. No. 9,133,599 uses a clamp type, the present skid device 20 uses a simpler direct bolt-on fitting, which is more secure and economical to produce than the tension fitment arrangement set forth in the skid device of U.S. Pat. No. 9,133,599.

The present skid device 20 has an improved attachment mechanism. Specifically, the universal fitment arrangement included in the present skid device 20 allows to be installed in any loader bucket with pre-drilled holes in the front edge for accommodating accessories, such as the edge plate 12, which also can be configured in a form of a toothbar (not illustrated). Specifically, the edge plate 12 can either receive a toothbar assembly or secure individual tooth thereto. The present fitting arrangement accommodates loader buckets with no accessories installed, as well as different edges of various sizes, and therefore can function as a primary or secondary edge-attached device. Mounting at least two skid devices 20 to the leading end of the loader bucket 10 allows the loader bucket to move material with minimal disturbance to the ground. Each skid device 20 can slide under the leading end (front edge 10*e*) of the loader bucket if the edge plate is not mounted or the front edge 12*fe* (or back edge 12*be* if reversely mounted) of the edge plate 12 if the edge plate 12 is mounted. By extending a bolt through the skid device 20, and up through the hole provided in the front side of the loader bucket, the skid device 20 can be secured in place using a fastener, namely a nut threaded to the bolt.

Figure 4:
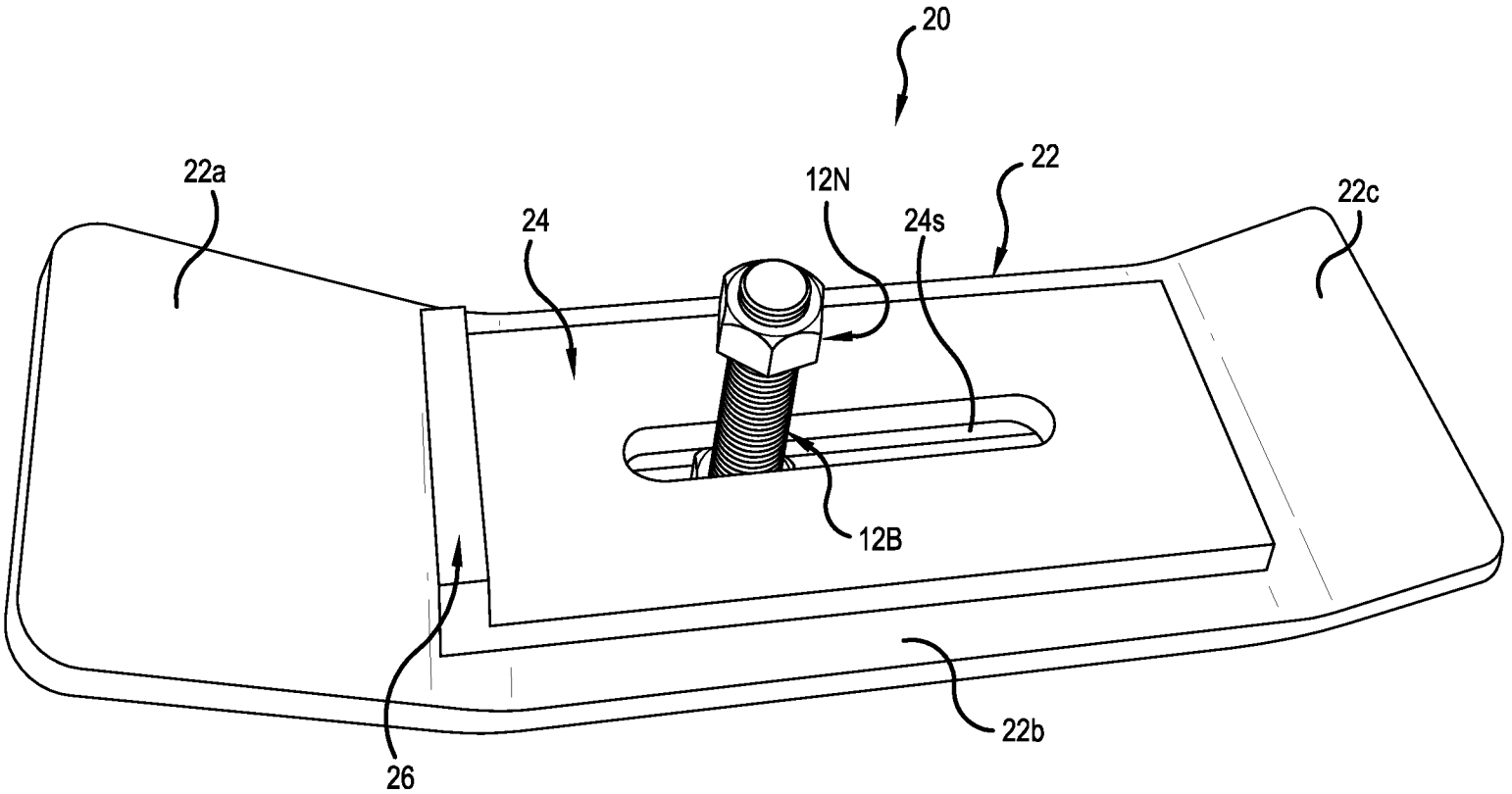
FIG. 4 illustrates a perspective view of the skid device illustrated in FIGS. 1-3.
Figure 5:
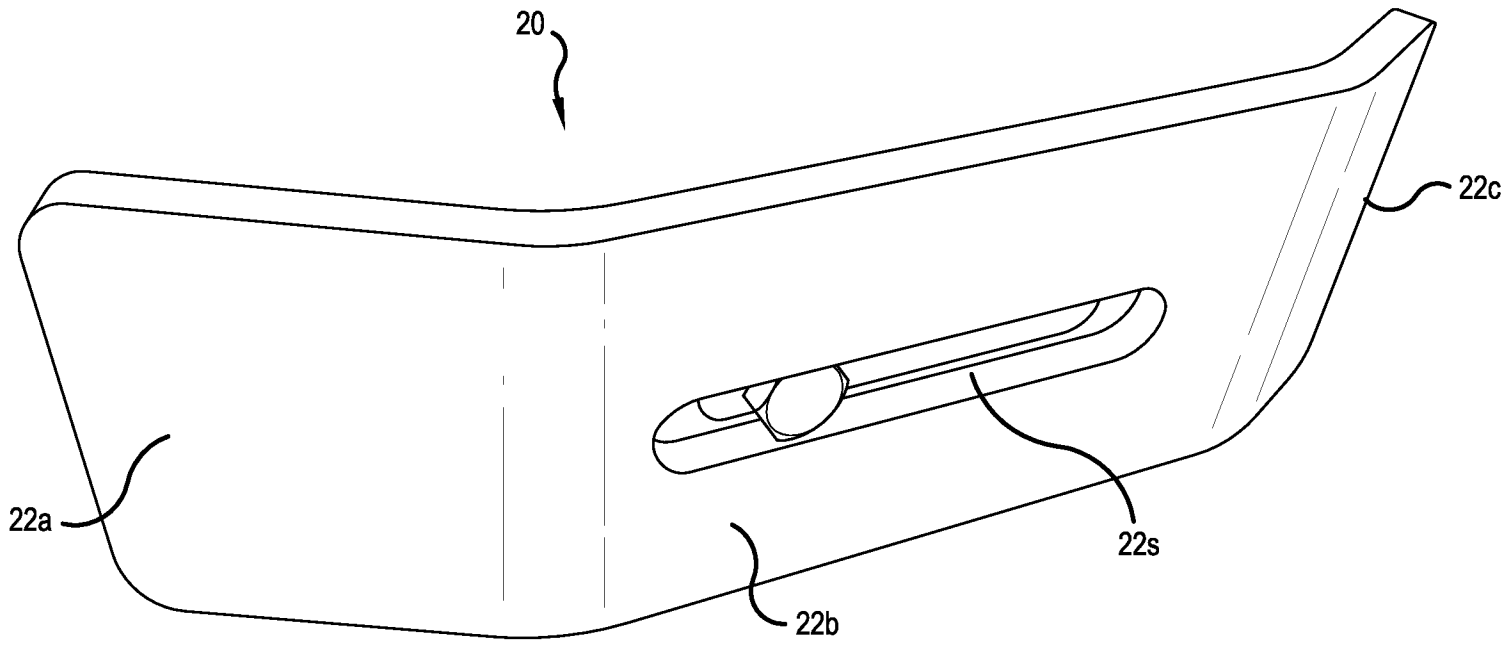
FIG. 5 illustrates another perspective view of the skid device illustrated in FIGS. 1-3.
Figure 6:
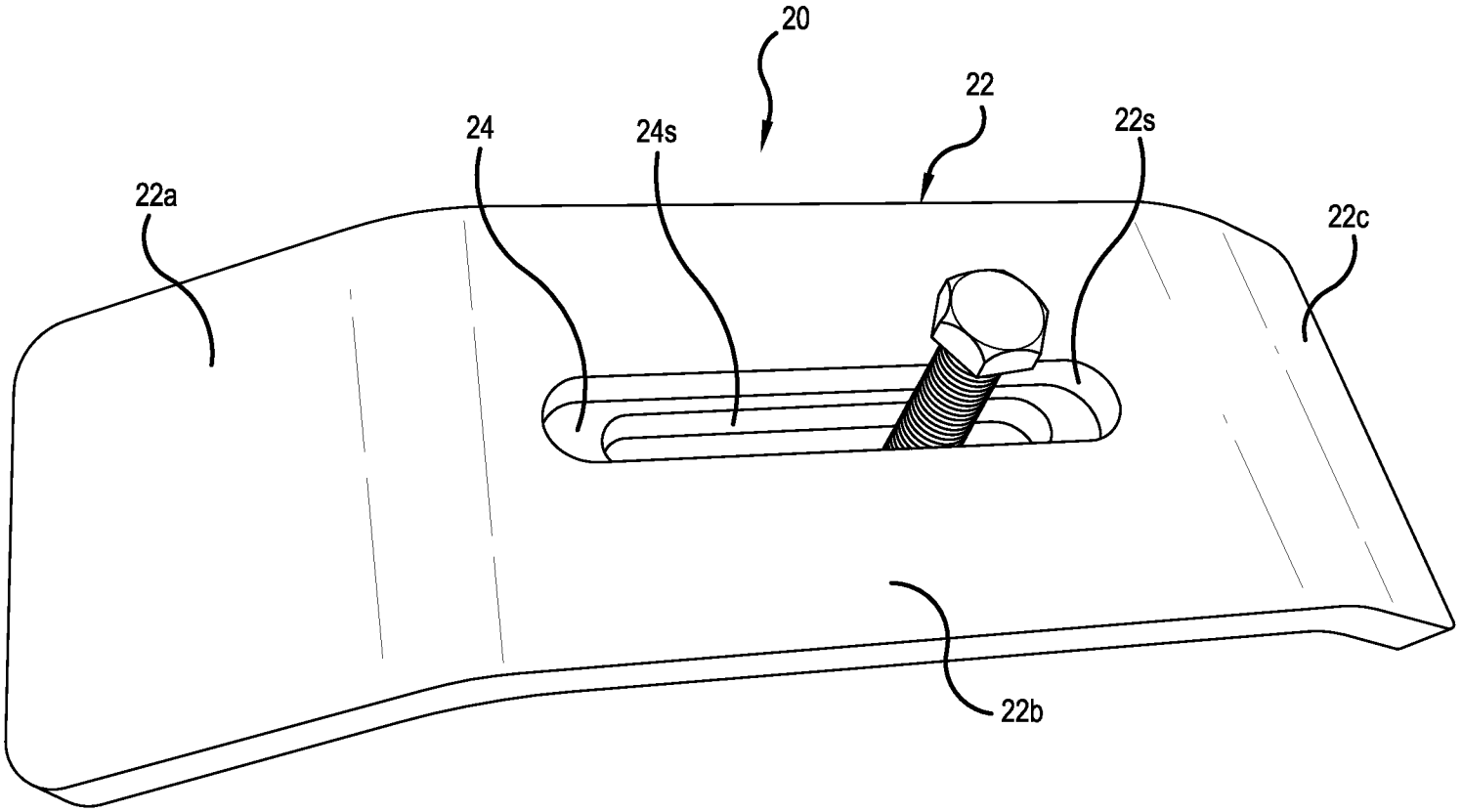
FIG. 6 illustrates another perspective view of the skid device to better illustrate the relationship between the sizes of the overlapping slots in the skid device.

Referring to FIGS. 4-6 in particular, the skid device 20 includes a base plate 22, a reinforcing plate (section) 24, and a stop member 26.

Referring to FIG. 4, the base plate 22 has an elongated body with ski shaped ends. Specifically, the base plate 22 includes a leading end (second) section 22*a*, a base (first) section 22*b*, and a trailing end (third) section 22*c*. Both the leading end section 22*a* and the trailing end section 22*c* can be angled or bent at any suitable degree, such as 20 degrees, similar to the way ski tips are raised. The angle, however, can be made different depending on use, namely higher angle for softer ground and lower angle for harder ground. That is, the angle can be less than or greater than 20 degrees. Moreover, the angles, as well as the length, of the leading end section and the trailing end section can be different from each other. The base section 22*b* is the primary load bearing area. In this respect, the base section 22*b* can be reinforced with the reinforcing plate 24, which can be a separate plate secured to the middle section or integrally or monolithically formed with the base section 22*b*.

The base section 22*b*, which contacts the ground, can be made from steel, namely a flat single steel plate, such as ⅜" thick steel or stainless steel. The size of the base plate 22 can vary according to the size of the loader bucket to be used. As an example, the base plate 22 can be approximately 12" long and 3" wide, with both the leading end section 22*a* and the trailing end section 22*c* angled up or bent at about 20 degrees. The above length refers to the length before the leading and trailing end sections 22*a*, 22*c* are angled/bent upwardly.

The base section 22*b* includes a slot 22*s* sized for passage of a bolt 12B, which can typically be sized ½," ⅝," ¾," or 1" in diameter, and sized to seat the bolt head and prevent a hex or plow bolt head from rotating when tightening or loosening torque is applied by the nut to the bolt when securing or loosening the skid device 20 to the loader bucket 10. For example, the slot can be ¾" in width for accommodating a ½" diameter bolt, centrally located (both width and length of the middle section 22*b*), extending longitudinally fore and aft. The slot can have a length ranging from 2"-6." The slot can be dimensioned to accept the head of a hex or plow bolt, allowing the bolt to slide to fit appropriately to the underside of the loader bucket. The bolt is insert up through one of the holes in the loader bucket, which is used for holding accessories, such as the edge plate 12 corresponding to a removable cutting edge. The base plate 22 is also dimensioned to fit underneath the loader bucket without the edge plate installed as previously explained.

In an alternative embodiment, the leading end and trailing end sections 22*a*, 22*c* can have a symmetrical angle and length to allow the skid device to be installed from either end to increase useful life by reversely installing the skid device after long use. In this respect, the stop member 26 can be removably mounted, such as using bolts to the reinforcing plate 24, to either end portion of the reinforcing plate 24.

The reinforcing plate 24, which is for reinforcing the base plate, in particular the base section 22*b* (flat portion) of the base plate 22 where the contact is made to the ground, can be attached to upper surface of the base section 22*b* extending between the sloped ends. The stop member 26 can be attached to the front end or top side of the reinforcing plate 24 either using bolts or by welding to the reinforcing plate 24 and/or the base section 22*b*. For example, the reinforcing plate 24 can be made of 2" wide by 6" long by ⅜" thick steel. The reinforcing plate 24 also includes a slot 24*s* that is aligned with the slot 22*s* in the base section 22*s*. For example, the slot can be ½" wide, which is narrower than the slot 22*s* to allow the shaft of the bolt to pass through, while preventing the head from passing through. The reinforcing plate 24 and the stop member 26 also can be formed integrally with the base plate 22, such as via casting, forging, or machining from a metal block.

It should be noted that the combination of the base plate 22 and the reinforcing plate 24 can be accomplished by milling a thicker base plate to form angled leading and trailing sections 22*a*, 22*c*, the stop member 26, the base section 22*b* having the desired thickness, and with a stepped slot having a recessed surface where the bolt head rests, namely with a wider bottom opening (e.g., ¾") and a narrower top opening (e.g., ½"). In this respect, skid device can be made of a single piece of steel or aluminum with a wear plate that can be steel and/or high density synthetic material. See FIG. 7. A reinforcing section refers to either a separate plate or the integrally thicker area of the base section 22*b*.

The stop plate 26 can abut against the front edge 12*fe* of the edge 12 or the front edge 10*e* of the loader bucket 10 for added security against the skid device 20 from moving backward when the bolt becomes loose, as well as preventing it from twisting on the bucket. The stop member 26 can be made of, for instance, a steel bar, such as ⅜"×⅜"×3," secured to the upper side of the reinforcing plate 24, such as by using bolts or welded to the front of and/or the top of the reinforcing plate 24, or integrally formed with the reinforcing plate 24. This serves as a pressure point against the leading edge 10*e*, 12*fe*, or 12*be* of the loader bucket 20.

In use, the stop member 26 would rest against the front of the loader bucket, ensuring that the entire unit remains aligned with the loader bucket, and serving as a protection to the skid device should the operator strike an object during operation.

Figure 7:
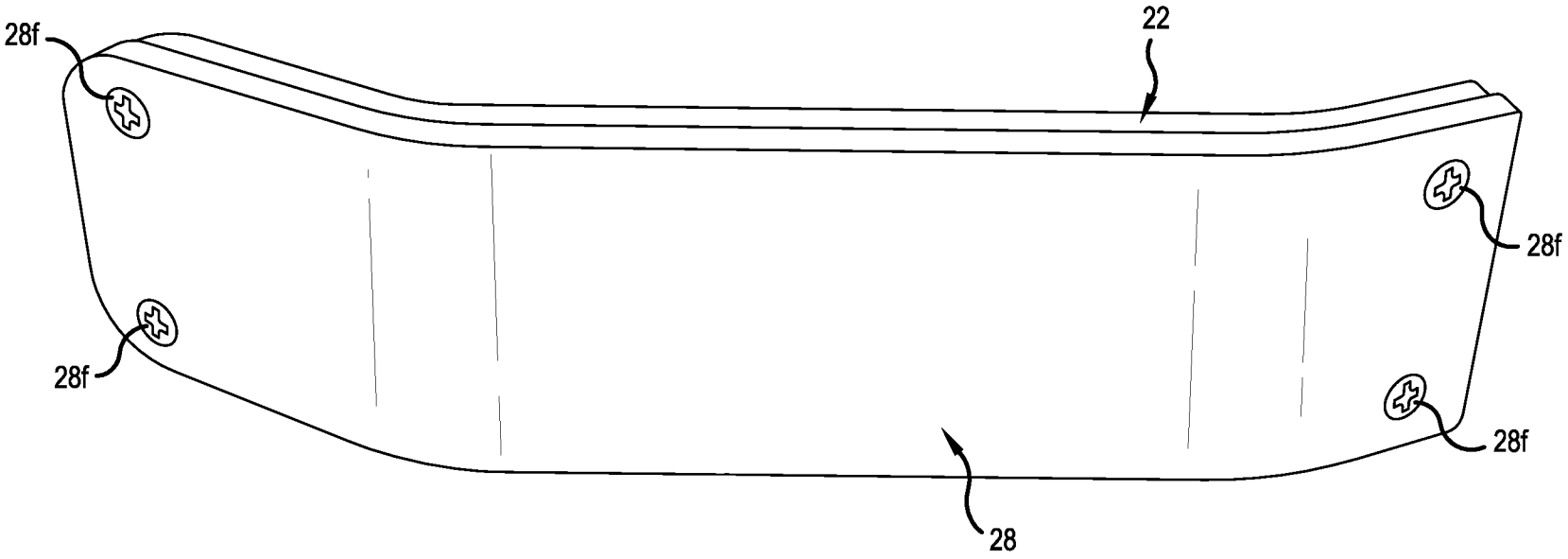
FIG. 7 illustrates another embodiment of the skid device that includes a replaceable wear plate.

FIG. 7 illustrates another embodiment that is essentially identical to the embodiment illustrated in FIGS. 1-6, but including a replaceable wear member or shoe 28 mounted to the base plate 22 of the skid device 20. In particular, the wear plate 28 is particularly desirable when the base plate 22 is made of less durable material, such as aluminum. The aluminum base plate 22 itself can be reinforced with a thin steel plate or shoe. Alternatively, the wear member 28 itself can be reinforced with a steel plate to increase strength and wear.

The wear member 28, which is replaceable, is shaped complementary to the base plate 22 to cover the exposed bottom surface of the entire base plate 22, including the slot 22*s* and secured thereto using conventional fasteners 28*f*. In the illustrated embodiment, two holes are drilled at each end of the base plate 22 and threaded to accept screws 28*f* to secure the wear member 28. The wear member 28 allows the loader bucket to glide over sensitive surfaces, such as grass or pavement, to prevent potential staining of concrete or paved surface due to paint or rust rubbing off the bottom of the base plate 22. In use, the bolt 12B would be inserted through the slot(s) 22*s*, 24*s* and then the wear member 28 would be secured to the base plate 22. This would capture the bolt 12B in place, namely prevent the bolt from falling off, while the bolt head can slide along the slot 22*s*.

The wear member 28 can be made from any number of materials conventionally used for such purpose, such as ultra-high-molecular-weight polyethylene (UHMWE) or polytetrafluoroethylene (PPTFE or otherwise known as TEFLON). The wear member can be cut and form-fitted to the same shape and dimensions as the base plate 22. In this respect, the wear member 28 also can be configured to cover both the lateral side edges of the base member along the full length, as well as the leading edge and the trailing edge thereof, for added protection.

Fasteners 28*f* are located in the angled portions near the leading and trailing end sections 22*a*, 22*c*. Two holes can be drilled through at each end portions of the wear member 28. The corresponding portions of the base plate 22 can be drilled through the base plate 22 and threaded to accept screws 28*f* to secure the wear member 28 thereto. Each fastener hole can be countersunk at the wear member 28 so that the fasteners, such as stainless steel screws, can be flush with or positioned deeper inside the wear member for added protection. Positioning the fasteners 28*f* near to the angled tip portion will minimize damage from the ground, enabling the removal of fasteners even if the wear member wears out.

Figure 8:
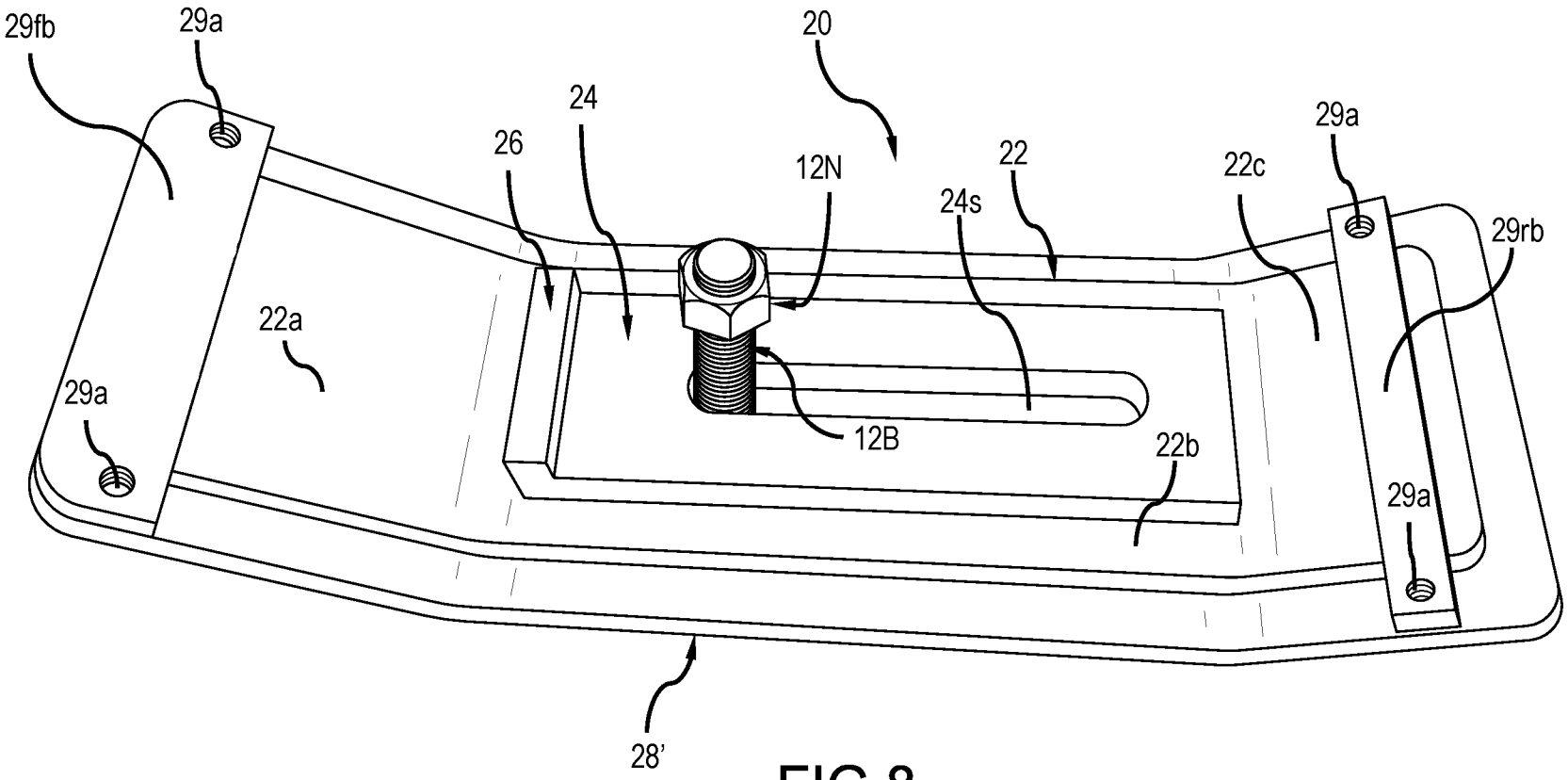
FIG. 8 illustrates another embodiment of the replaceable wear plate.

FIG. 8 illustrates another embodiment of the wear member 28', which is similar to the wear member 28 illustrated in FIG. 7. In the embodiment of FIG. 8, the wear member 28' is wider than the wear member 28 of FIG. 7 to accommodate front and rear mounting brackets 29*fb*, 29*rb* for securing the wear member 28' to the base plate 22. Instead of the fasteners 28*f* engaging the respective threaded holes in the base plate 28, the fasteners 28*f* are secured to the threaded holes 29*a* formed in each of the front and rear mounting brackets 29*fb*, 29*rb* in the respective areas of the base plate 22, namely at the front and rear ends or near those ends. The mounting brackets 29*fb*, 29*rb* secured to the wear member 28' confine or sandwiched the base plate 22 therebetween. In particular, each of the front and rear mounting brackets 29*fb*, 29*rb* includes a slot or recess that is less than the thickness of the wear member 28' to seat the respective front and rear end portions of the base plate 22 therein and permit the front and rear mounting brackets to clamp down on the front and rear end portions of the base plate 22. Each of the front and rear mounting brackets 29*fb*, 29*rb* can be made of steel or aluminum or other suitable strong material that can maintain the wear member 28' secured to the base plate. This configuration allows the wear member 28' to be mounted to the skid plate without any drilling holes in the base plate 22.

Figure 9:
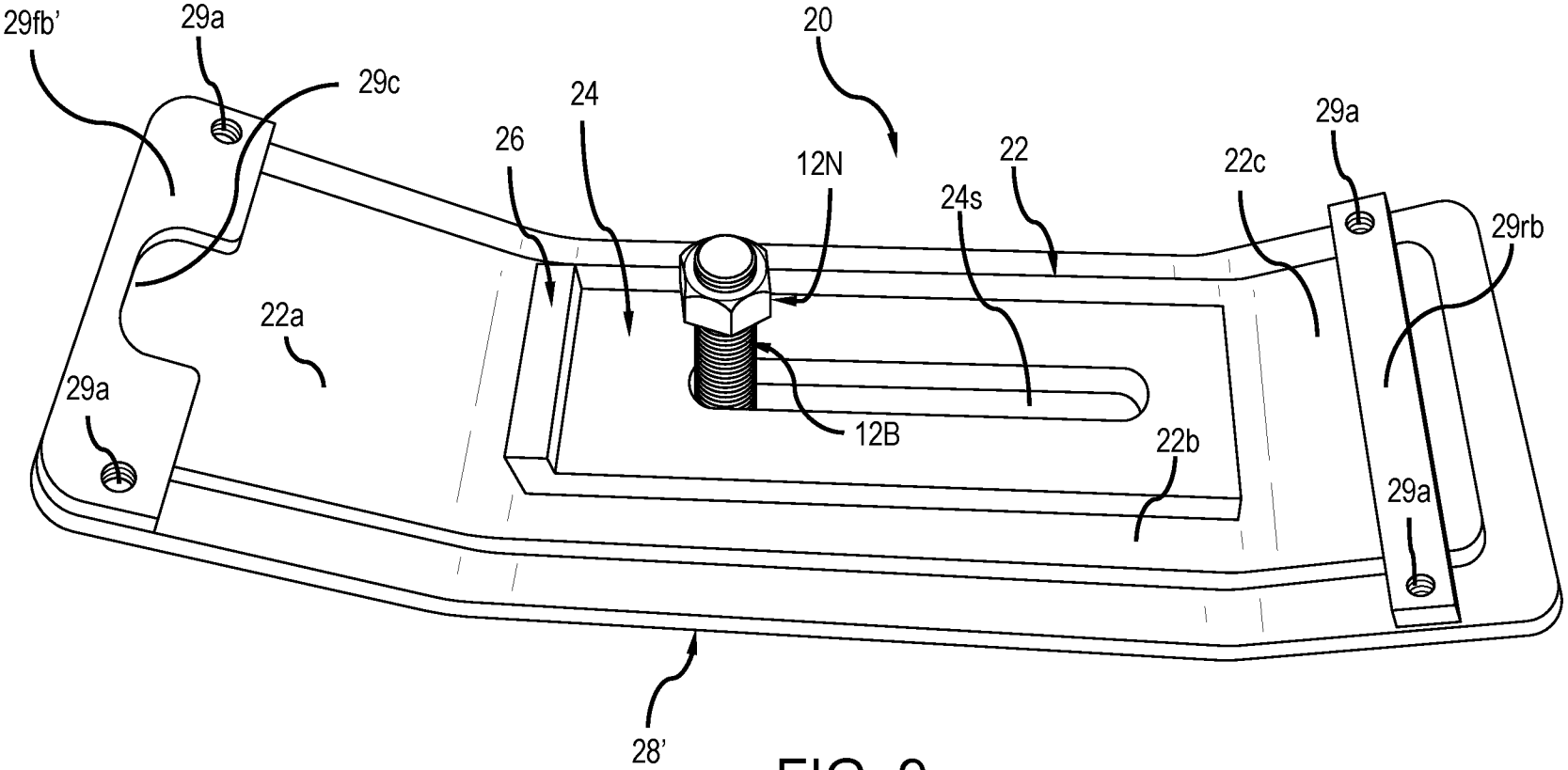
FIG. 9 illustrates an embodiment similar to FIG. 8.

The embodiment of FIG. 9 is identical to the embodiment of FIG. 8 except for the configuration of the mounting bracket 29*fb*. In the embodiment of FIG. 9, the wear member 28' uses mounting brackets 29*fb*', 29*rb*. The mounting bracket 29*fb*' includes a cutout 29*c* to accommodate different skid plates, including for example the skid plate disclosed in U.S. Pat. No. 9,133,599, where a reinforcing gusset is provided to mount an auxiliary member. The cutout 29*c* can accommodates the gusset or similar structure. The present skid plate 20 also can include a similar gusset 42 for mounting a similar auxiliary member 50 as illustrated in FIGS. 10-11.

Alternatively, other methods of fastening the wear member 28 can be contemplated. For example, as described in U.S. Pat. No. 9,133,599, the bottom of the base plate 22 can have dove-tail recesses or protrusions or the like and the upper surface of the wear member 28 can have complementary dove-tail protrusions or recesses to allow the wear member to be installed to the base member by sliding it sideways (perpendicular to the fore and aft direction FA) and held with an interference fit. Screws also can be used to retain the wear member from sliding sideways.

Figure 10:
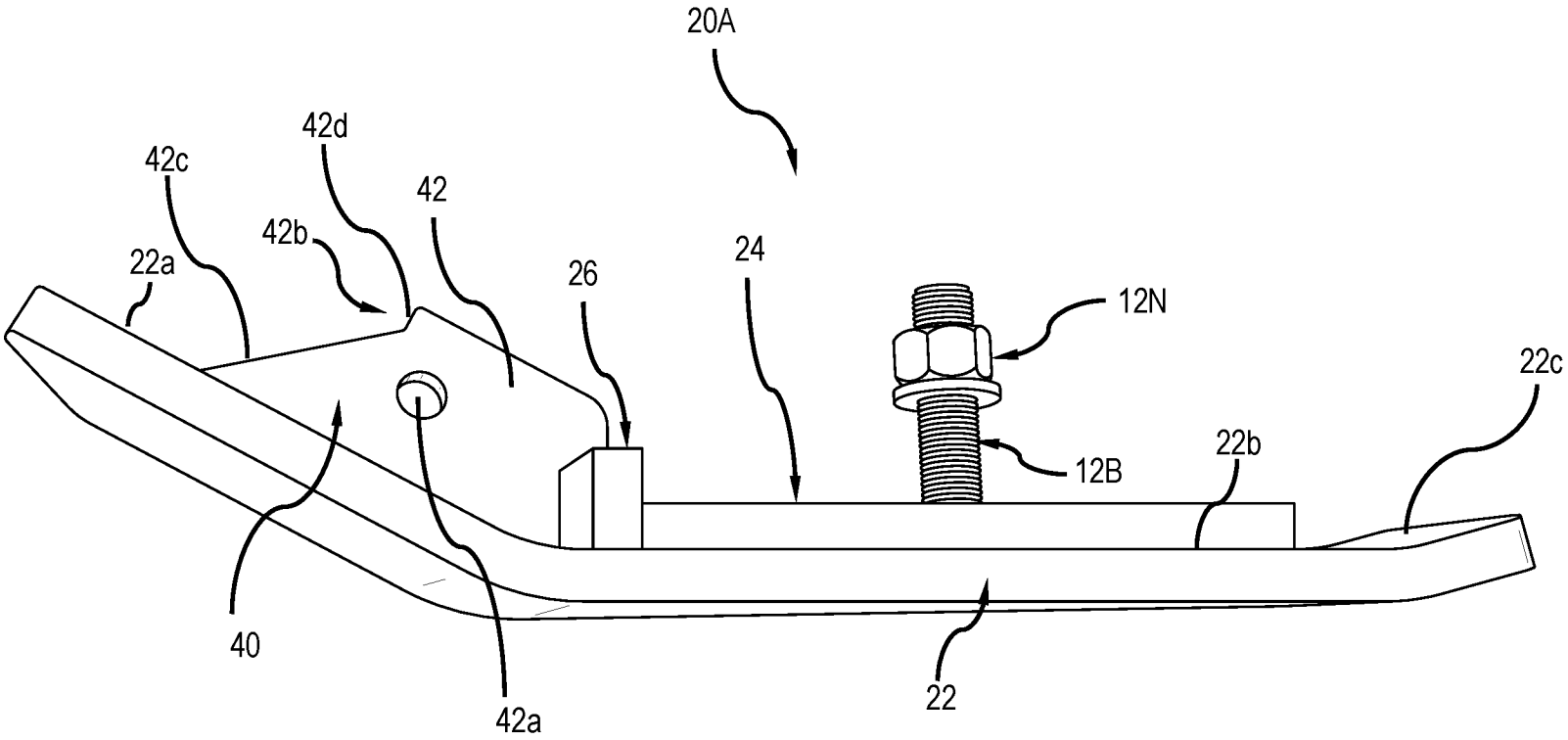
FIG. 10 illustrates another embodiment of the skid device similar to the previously mentioned embodiments, but provided with an accessory mount.
Figure 11:
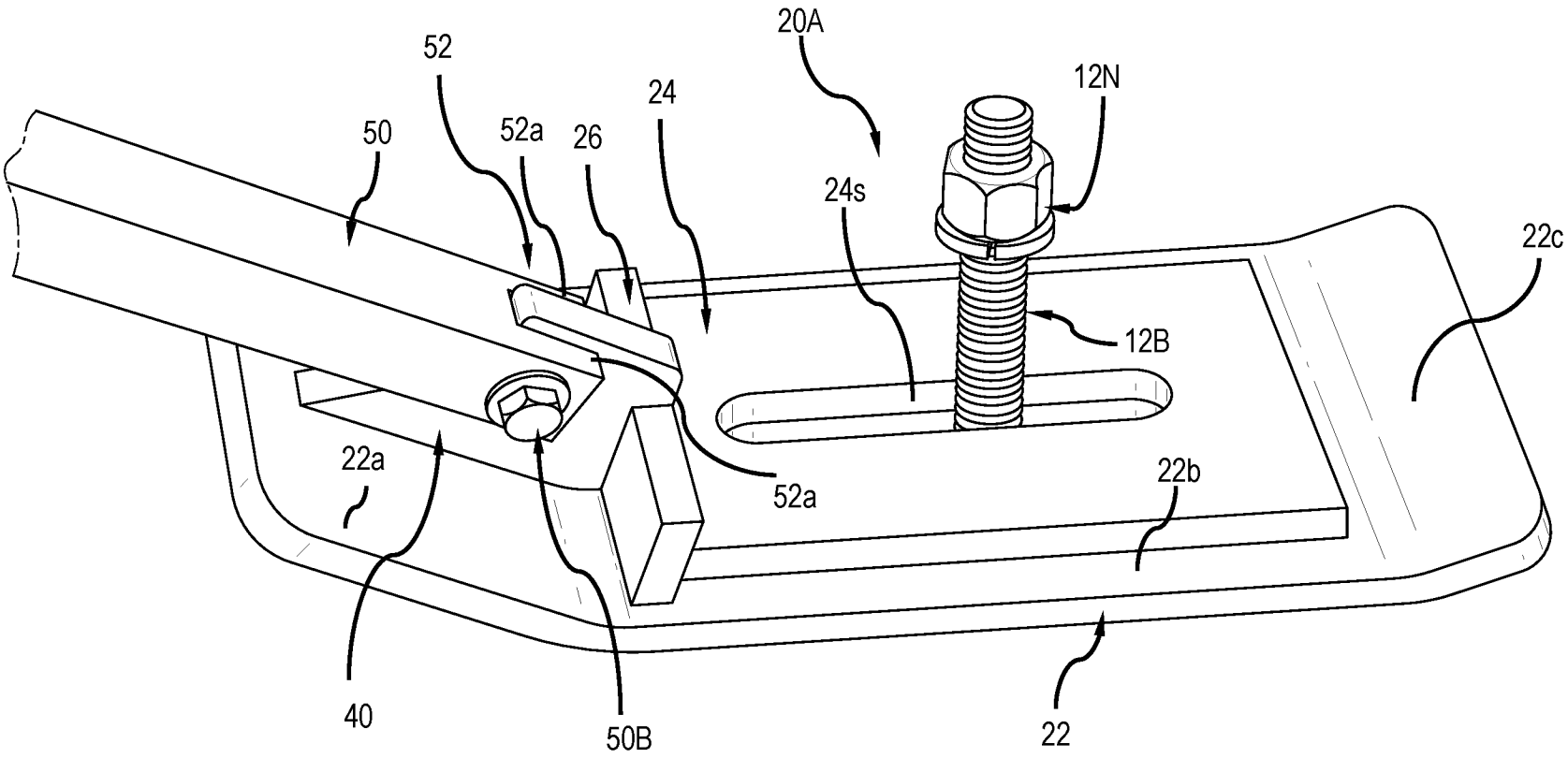
FIG. 11 illustrates an accessory mounted to the skid device of the embodiment of FIG. 10.

The embodiment of FIGS. 10-11 can use the previously discussed embodiments. This embodiment can use an extension bar or an accessory member 50 attached to the skid device 20A as an auxiliary member, similarly as disclosed in U.S. Pat. No. 9,133,599. Specifically, the skid device 20A in this embodiment includes an accessory mount 40 that reinforces the leading end section 22*a*, as well as the stop member 26. The accessory mount 40 can be made of a metal plate or gusset 42 with a thickness of ⅜" for example. But the thickness can vary according to the size of the skid device 20A. The gusset 42 can be welded to the leading section 22*a* and the stop member 26 or integrally formed with the base plate 22 and the stop member 26, which also can be integral with the base plate 22. The gusset 42 strengthens the skid device, as well as preventing the leading end section 22*a* from bending relative to the base section 22*b*.

Referring to FIG. 10, the gusset 42 includes a hole 42*a* for insertion of a fastener, such as a bolt 50B (see FIG. 11), and a notch 42*b* at the top of the gusset 42 functioning as a stop to prevent the accessory member 50 (see FIG. 11) from pivoting upwards. Specifically, the gusset 42 has a sloped wall 42*c* that meets an upright wall 42*d*, forming the notch 42*b* at the intersection. The upright wall 42*d* functions as a stop to abut the wall formed between the arm portions 52*a* of the yoke, which is further described below.

At least one removable auxiliary member 50, which can serve as a support for a large item that is longer than the width of the bucket or long article with a hole, such as a large pipe, can be mounted to each skid device mounted to the bucket, similarly as described in U.S. Pat. No. 9,133,599, the description thereof being incorporated by reference. For example, each auxiliary member 50 can be formed of steel, such as a bar having 12" long and 1" square. The auxiliary member 50 can be connected via a bolt 50B, or the like, extending through a hole formed in the reinforcement member and secured with a nut (not illustrated). In this respect, a proximal end of the auxiliary member can have a yoke configuration 52 that can straddle the accessory mount 40. The yoke configuration has a hole on each arm portion 52*a* thereof to permit insertion of a fastener, such as a bolt 50B or the like. Although the drawings illustrate the auxiliary member 50 in a form of a bar, it need not be bar shaped. The auxiliary member 50 can have any desired configuration to suit the purpose of carrying objects or other functions that extend the use of the a loader bucket.

In use, at least two skid devices 20, 20A are installed spaced along the leading end of the loader bucket 10 by sliding each skid device over the leading end of the loader bucket and inserting a bolt 12B up through the slots 22*s* and 24*s* from the bottom thereof of each skid device 20, 20A, through the edge 12 if used, and through one of the mount holes in the loader bucket 10, and securing it with a nut 12N. The skid device 20, 20A can be loosened and adjusted forward and back (fore and aft) on the loader bucket, to ensure that the stop member 26 rests securely against the front edge 12*fe* of the edge plate 12 or the front edge 10*e* of the loader bucket 10. The stop member 26 ensures a square alignment relative to the leading edge of the bucket, and decreases the chance of loader bucket damage, should the operator strike an object driving the tractor forward while the nut 12N becomes loose.

Using at least two skid devices 20, 20A installed to a loader bucket 10 allows snow, mulch, and other such materials to be moved with less disturbance to the underlying ground surface. For example, the movement of snow on a gravel driveway or the lifting of mulch or cut wood off a lawn can be achieved with the present development.

Given the present disclosure, one versed in the art would appreciate that there may be other embodiments and modifications within the scope and spirit of the present development. Accordingly, all modifications attainable by one versed in the art from the present disclosure within the scope and spirit of the present development are to be included as further embodiments of the present development. The scope of the present invention accordingly is to be defined as set forth in the appended claims.

What is claimed is:

1. A skid device mountable to a loader bucket including a plurality of mounting holes for securing an accessory to a bottom side of the loader bucket at a front side thereof, with a portion of the accessory extending forwardly of a front edge of the loader bucket in a state where the accessory is mounted to the loader bucket, the skid device comprising:

a base plate including:

a first section with a slot extending in a fore and aft direction of the base plate;

a second section extending outwardly and angled upwardly from the first section; and a third section extending outwardly and angled upwardly from the first section, the second and third sections extending in opposite directions along the fore and aft direction from the first section;

a stop member disposed at an upper side of the first section adjacent to one of the second or third section configured to abut a leading end of the loader bucket, wherein a width of the slot is dimensioned to permit a threaded shaft of a fastener to pass through and a mounting hole, among the plurality of mounting holes in the loader bucket, from a bottom side of the first section, while preventing a head of the fastener, which is disposed at one end of the threaded shaft and dimensioned larger than the threaded shaft, from passing completely through the slot, and wherein a length of the slot provides a fore and aft adjustment that allows the skid device to be mountable to the loader bucket with or without the accessory mounted, so that the stop member abuts the leading end, which is either the front edge of the loader bucket in a state where the accessory is not mounted to the loader bucket or a front edge of the accessory extending forwardly of the front edge of the loader bucket in the state where the accessory is mounted to the loader bucket.

2. The skid device according to claim 1, wherein the accessory is an edge plate.

3. The skid device according to claim 2, wherein:

the base plate is made of monolithic aluminum or steel, and the first section is thicker than each of the second and third sections.

4. The skid device according to claim 1, further including a reinforcing section extending upwardly from the first section.

5. The skid device according to claim 4, wherein the stop member extends upwardly from the first section or the reinforcing section.

6. The skid device according to claim 1, wherein the slot is stepped or countersunk deeper than a thickness of the head of the fastener so that the head is at least flush with a bottom surface of the first section.

7. The skid device according to claim 4, wherein the reinforcing section has a slot that is narrower than the slot in the first section and permits the threaded shaft of the fastener to extend therethrough but prevents the head of the fastener from passing through.

8. The skid device according to claim 1, further comprising a wear member removably secured to a lower side of the base plate and configured complementary to a configuration of the base plate and cover a bottom surface of the base plate.

9. The skid device according to claim 1, wherein:

the stop member is disposed extending upwardly in the first section nearer to the second section than the third section, the skid device is mountable to another loader bucket including the plurality of mounting holes for securing the accessory to the bottom side thereof at the front side thereof, but sized smaller or larger than the loader bucket, the length of the slot providing sufficient fore and aft adjustment to allow the stop member to abut the leading edge of the another loader bucket in a state where the skid device is mounted to the another loader bucket, and the second section extends forwardly of the leading end of the respective loader bucket in a state where the skid device is mounted to the loader bucket or the another loader bucket.

10. The skid device according to claim 1, further comprising:

an accessory mount extending from the first section and the stop member, wherein the auxiliary member is removably attachable to the accessory mount.

11. The skid device according to claim 10, wherein:

the accessory mount comprises a gusset plate with a notch that prevents the auxiliary member from pivoting upwardly in a state where the auxiliary member is mounted to the accessory mount.

12. A loader bucket assembly for moving material, the bucket assembly comprising:

a loader bucket including a plurality of mounting holes for securing an accessory to a bottom side of the loader bucket at a front side thereof, with a portion of the accessory extending forwardly of a front edge of the loader bucket in a state where the accessory is mounted to the loader bucket; and at least two skid devices each mounted to the loader bucket using a fastener through a mounting hole, among the plurality of mounting holes in the loader bucket, wherein each of the two skid devices includes:

a base plate including:

a first section with a slot extending in a fore and aft direction of the base plate;

a second section extending outwardly and angled upwardly from the first section; and a third section extending outwardly and angled upwardly from the first section, the second and third sections extending in opposite directions along the fore and aft direction from the first section;

a stop member disposed at an upper side of the first section adjacent to one of the second or third section and configured to abut a leading end of the loader bucket, wherein a width of the slot is dimensioned to permit a threaded shaft of the fastener to pass through a mounting hole, among the plurality of mounting holes in the loader bucket, from a bottom side of the first section, while preventing a head of the fastener, which is disposed at one end of the threaded shaft and dimensioned larger than the threaded shaft, from passing completely through the slot, and wherein a length of the slot provides a fore and aft adjustment that allows the skid device to be mounted to the loader bucket with or without the accessory mounted, so that the stop member abuts the leading end, which is either the front edge of the loader bucket in a state where the accessory is not mounted to the loader bucket or a front edge of the accessory extending forwardly of the front edge of the loader bucket in the state where the accessory is mounted to the loader bucket.

13. The loader bucket assembly according to claim 12, wherein the accessory is an edge plate.

14. The loader bucket assembly according to claim 12, wherein:

the base plate is made of monolithic aluminum or steel, and the first section is thicker than each of the second and third sections.

15. The loader bucket assembly according to claim 12, further including a reinforcing section extending upwardly from the first section.

16. The loader bucket assembly according to claim 15, wherein the stop member extends upwardly from the first section or the reinforcing section.

17. The loader bucket assembly according to claim 12, wherein the slot is stepped or countersunk deeper than a thickness of the head of the fastener so that the head is at least flush with a bottom surface of the first section.

18. The loader bucket assembly according to claim 15, wherein the reinforcing section has a slot that is narrower than the slot in the first section and permits the threaded shaft of the fastener to extend therethrough but prevents the head of the fastener from passing through.

19. The loader bucket assembly according to claim 12, further comprising a wear member removably secured to a lower side of the base plate and configured complementary to a configuration of the base plate and cover a bottom surface of the base plate.

20. The loader bucket assembly according to claim 12, wherein:

the stop member is disposed extending upwardly in the first section nearer to the second section than the third section, the skid device is mountable to another loader bucket including the plurality of mounting holes for securing the accessory to the bottom side thereof at the front side thereof, but sized smaller or larger than the loader bucket, the length of the slot providing sufficient fore and aft adjustment to allow the stop member to abut the leading edge of the another loader bucket in a state where the skid device is mounted to the another loader bucket, and the second section extends forwardly of the leading end of the respective loader bucket in a state where the skid device is mounted to the loader bucket or the another loader bucket.

21. A method of mounting a skid device to a loader bucket including a plurality of mounting holes for securing an accessory to a bottom side of the loader bucket at a front side thereof, with a portion of the accessory extending forwardly of a front edge of the loader bucket in a state where the accessory is mounted to the loader bucket, the method comprising the steps of:

providing the skid device, which comprises:

a base plate including:

a first section with a slot extending in a fore and aft direction of the base plate;

a second section extending outwardly and angled upwardly from the first section; and a third section extending outwardly and angled upwardly from the first section, the second and third sections extending in opposite directions along the fore and aft direction from the first section;

a stop member disposed at an upper side of the first section adjacent to one of the second or third section and configured to abut a leading end of the loader bucket, wherein a width of the slot is dimensioned to permit a threaded shaft of a fastener to pass through a mounting hole, among the plurality of mounting holes in the loader bucket, from a bottom side of the first section, while preventing a head of the fastener, which is disposed at one end of the threaded shaft and dimensioned larger than the threaded shaft, from passing completely through the slot, and wherein a length of the slot provides a fore and aft adjustment that allows the skid device to be mountable to the loader bucket with or without the accessory mounted, so that the stop member abuts the leading end, which is either the front edge of the loader bucket in a state where the accessory is not mounted to the loader bucket or a front edge of the accessory extending forwardly of the front edge of the loader bucket in the state where the accessory is mounted to the loader bucket;

disposing the skid device underneath the load bucket so that the first section is underneath the load bucket and the stop member is disposed close to or abutting the leading end of the loader bucket;

aligning the slot with the mount hole;

inserting the threaded shaft of the fastener through the slot and into the mount hole; and securing the skid device to the load bucket by fastening a nut on the thread shaft and tightening the nut while the stop member is abutting the leading end.

* * * * *